United States Patent [19]

Kato et al.

[11] Patent Number: 5,066,252

[45] Date of Patent: Nov. 19, 1991

[54] RETAINER FOR METAL TERMINAL OF ELECTRIC CONNECTOR

[75] Inventors: Tetsuo Kato; Kiyohito Fukuda; Hiroshi Watanabe; Katsuaki Terada; Naoto Taguchi, all of Shizuoka, Japan

[73] Assignee: Yazaki Corporation, Tokyo, Japan

[21] Appl. No.: 544,727

[22] Filed: Jun. 27, 1990

[30] Foreign Application Priority Data

Jun. 27, 1989 [JP] Japan ..... 1-162627

[51] Int. Cl.[5] ..... H01R 13/436

[52] U.S. Cl. ..... 439/752; 439/595

[58] Field of Search ..... 439/595, 752, 733

[56] References Cited

U.S. PATENT DOCUMENTS

| | | | |
|---|---|---|---|
| 4,319,799 | 3/1982 | Pearce, Jr. | 439/752 |
| 4,772,229 | 9/1988 | Nix et al. | 439/733 |
| 4,804,341 | 2/1989 | Kato et al. | 439/752 |
| 4,867,712 | 9/1989 | Kato et al. | 439/752 |
| 4,946,399 | 8/1990 | Kawashima | 439/752 |

FOREIGN PATENT DOCUMENTS

| | | | |
|---|---|---|---|
| 54677 | 3/1989 | Japan | 439/752 |
| 64-54678 | 3/1989 | Japan . | |

*Primary Examiner*—Gary F. Paumen

*Attorney, Agent, or Firm*—Sughrue, Mion, Zinn, Macpeak & Seas

[57] ABSTRACT

In an electric connector, a terminal retainer prevents accidental locking of the terminal retainer in a connector housing by requiring two locking steps. The connector housing includes a lid member with a recess which mates with a step of a window which also is provided in the connector housing. The recess mates with the step at two different positions, the first of which is a provisional locking position. At the second position, a locking arm grips the lid member, while the recess mates with the step at the second position. This is a complete locking position.

6 Claims, 7 Drawing Sheets

RETAINER FOR METAL TERMINAL OF ELECTRIC CONNECTOR

BACKGROUND OF THE INVENTION

This invention relates to a terminal retainer connected to a connector housing of an electric connector, used for connection of wire harnesses or the like, to prevent a metal terminal, inserted in a terminal receiving chamber of the connector housing, from rearward withdrawal.

A common method of retaining a metal terminal received in a connector housing includes forming a flexible retaining arm integrally on an inner wall of a terminal receiving chamber, and causing the retaining arm to engage the metal terminal to be inserted into the terminal receiving chamber, thereby preventing rearward withdrawal of the metal terminal.

However, an adequate force for retaining the metal terminal cannot be obtained with the flexible retaining arm alone. Recently, an arrangement has been proposed in which a separate terminal retainer is used in combination with a connector housing to prevent more positively the withdrawal of the metal terminal. FIGS. 7 to show one such conventional retainer construction, disclosed in detail in Japanese Laid-open (Kokai) Patent Application No. 54678/89.

In this conventional construction, as shown in FIGS. 7A and 7B, a flexible retaining arm c engageable in a retaining hole g in a metal terminal f is provided at a terminal receiving chamber b of an insulative housing a. A through hole d communicating with the terminal receiving chamber b is formed in the outer peripheral wall of the insulative housing a, and a flexible lock portion e is formed on the edge of the through hole d. A double retainer member i is inserted into the through hole d and is engaged with the metal terminal f, thereby achieving a double retention function.

As shown in FIG. 8, the double retainer member i is made up of a plurality of plate-like bodies j integrally interconnected at their upper ends by a connecting plate k to provide a tooth-like configuration. Each plate-like body j has at its side retaining projections l which cooperate with retaining pieces h formed on the metal terminal f in an upstanding manner (FIG. 9). Complete lock pieces m are provided on the upper end portion (i.e., the connecting plate k) of the double retainer member i, and provisional lock pieces n are provided on the lower end portion (i.e., the lower ends of the plate-like bodies j).

FIG. 7A shows a provisionally-locked condition of the double retainer member i. Each provisional lock piece m of the plate-like body j inserted in the through hole d is engaged with a partition wall b of the terminal receiving chamber b, and each lock piece m is supported on the lock portion e of the insulative housing a, thus provisionally locking the double retainer member i. In this condition, since the retaining projections l are disposed outside of the terminal receiving chamber b, the insertion and removal of the metal terminal f can be made freely, and if the insertion is complete, the flexible retaining arm c is engaged in the retaining hole g to effect a primary retention function.

FIG. 7B shows a complete-locked condition of the double retainer member i. When this member i is depressed in a direction of an arrow in FIG. 7A, the lock portion e is flexed, so that each complete lock piece m is moved downwardly, thereby effecting complete locking. At the same time, the retaining projections l are moved into the receiving chamber to be disposed behind the retaining pieces h, and therefore the rearward withdrawal of the metal terminal f can be prevented in two different ways.

In the just-described conventional connector, since the double retainer member i can be provisionally locked relative to the insulative housing a, the two can be handled in a combined manner. This is convenient for transport and storage. However, the double retainer member can be changed from the provisionally-locked condition into the completely-locked condition in a single step, and therefore there is a possibility that the double retainer member inadvertently may be put into the completely-locked condition during transport or assembly of the connector, so that the metal terminal cannot be inserted. In this case, additional time is required to return the connector to its provisionally-locked condition.

Further, each body j of the double retainer member i is made of a thin plate, which does not have adequate strength. Therefore, there is another problem in that, when the double retainer member is inserted into the insulating housing, the bodies j may be flexed, so that the insertion operation cannot be carried out easily. Still further, the retaining projections l which cooperate with the retaining pieces h of the metal terminal f are provided on the side of the plate-like body, and therefore there is a further problem in that the retaining projections are small, thus failing to provide a sufficient retaining force.

SUMMARY OF THE INVENTION

In view of the foregoing, it is an object of this invention to provide a terminal retainer in which a double retainer member for a metal terminal is shifted relative to a connector housing from a provisionally-locked condition into a completely-locked condition in two steps, thereby eliminating inadvertent complete locking of the double retainer member, and in which the retaining portions for the metal terminal are strong, thus providing a large retaining force.

Thus, the invention provides a terminal retainer for an electric connector, the electric connector being made up of a connector housing having a plurality of juxtaposed terminal receiving chambers, and metal terminals which are inserted into respective ones of the terminal receiving chambers. The terminal retainer is combined with the connector housing and is shifted from a provisionally-locked condition to a completely-locked condition.

Each metal terminal has a retaining hole formed in its base, and a window is provided in one of the opposed outer peripheral walls of the connector housing, the window extending across the plurality of terminal receiving chambers, and extending through the connector housing to the other outer peripheral wall. A deformable hook-shaped locking arm is provided at one side edge of the window in facing relation to the extending-through space. The terminal retainer has a lid member for closing the window, and partition plates connected to the lid member and corresponding to the plurality of terminal receiving chambers. At its inner surface, the lid member has retaining projections, each engageable in the retaining hole of a respective one of the metal terminals, and a projection engageable with the locking arm.

In operation, the terminal retainer is provisionally locked upon insertion into the connector housing from the window. In the provisionally-locked condition, when the terminal retainer is inserted in such a manner that the terminal retainer is moved toward the locking arm, the locking arm is engaged with an end face of the projection, thereby completely locking the terminal retainer. At the same time, the retaining projection is engaged in the retaining hole, thereby preventing rearward withdrawal of the metal terminal.

In the case where the plurality of juxtaposed terminal receiving chambers are arranged in the connector housing in upper and lower rows, the window for receiving the terminal retainer is provided in one outer peripheral wall of the connector housing and also in the partition walls, separating the upper and lower rows of terminal receiving chambers from each other, so that the window extends vertically through the connector housing. The retaining projections, engageable in respective retaining holes of the metal terminals, are formed on the lid members for closing the open portions of the window.

In order to prevent positively a rearward withdrawal of the metal terminal, in addition to the provision of the retaining projection of the terminal retainer engageable in the retaining hole in the metal terminal, a retaining piece preferably is formed on the base of the metal terminal, in which case a retaining wall which engages the retaining piece is provided at a side face of the retaining projection of the lid member.

The inventive terminal retainer cannot be brought into the completely-locked condition if the terminal retainer is not moved in a direction perpendicular to the direction of insertion thereof after the terminal retainer is brought into the provisionally-locked condition. Therefore, during transport and assembly of the connector, the terminal retainer will not be brought inadvertently into the completely-locked condition. As a result, insertion of the metal terminal can be effected smoothly.

The terminal retainer has a frame which is made up of upper and lower lid members, the partition plates interconnecting the lid members, the pitch of the partition plates being equal to the pitch of the terminal receiving chambers. With this construction, the terminal retainer is stronger, the retaining portions thereof will not be deformed or damaged by the metal terminal, and assembly of the connector can be facilitated.

Further, the terminal retainer has retainer projections and the retaining walls which are engageable with the retaining holes and the retaining pieces of the metal terminals, respectively. Therefore, in combination with the known retaining structure acting between the metal terminal and the terminal receiving chamber, this construction provides a strong retaining or holding force, and rearward withdrawal of the metal terminal is positively prevented.

DETAILED DESCRIPTION OF THE PREFERRED EMBODIMENTS

Figure 1:
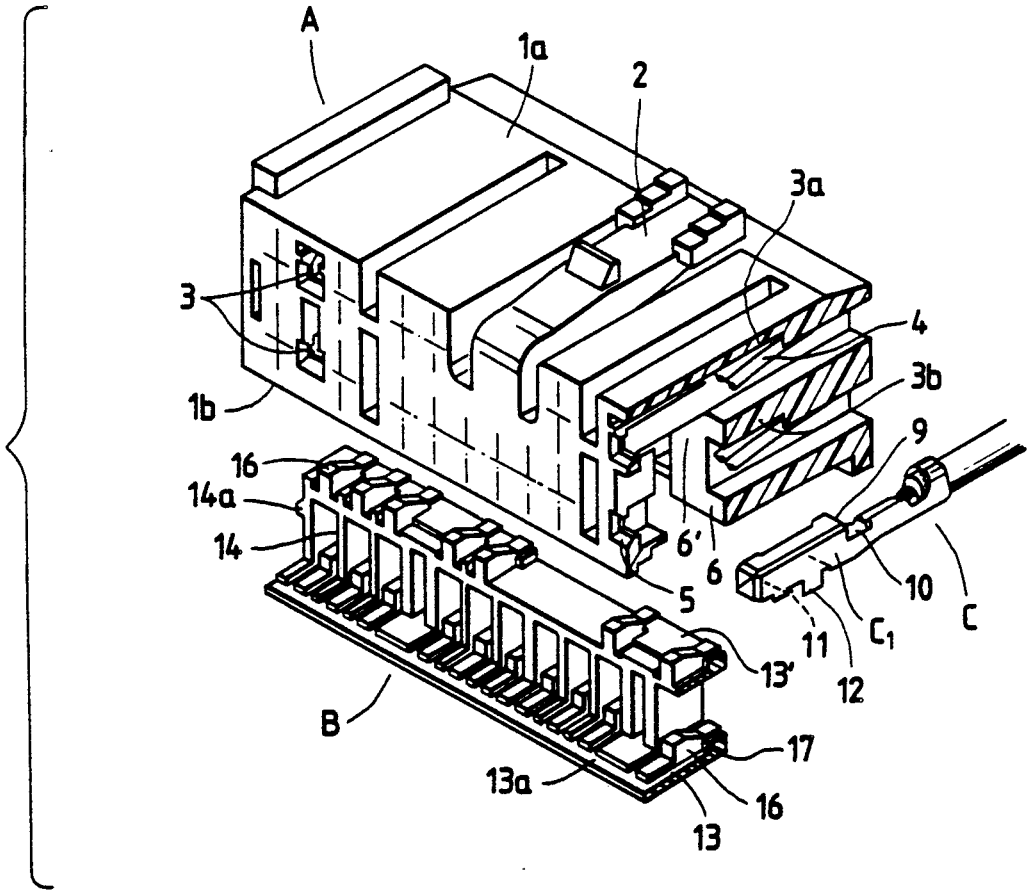
FIG. 1 is an exploded perspective view of important portions of a connector housing and a terminal retainer of the present invention.
Figure 2:
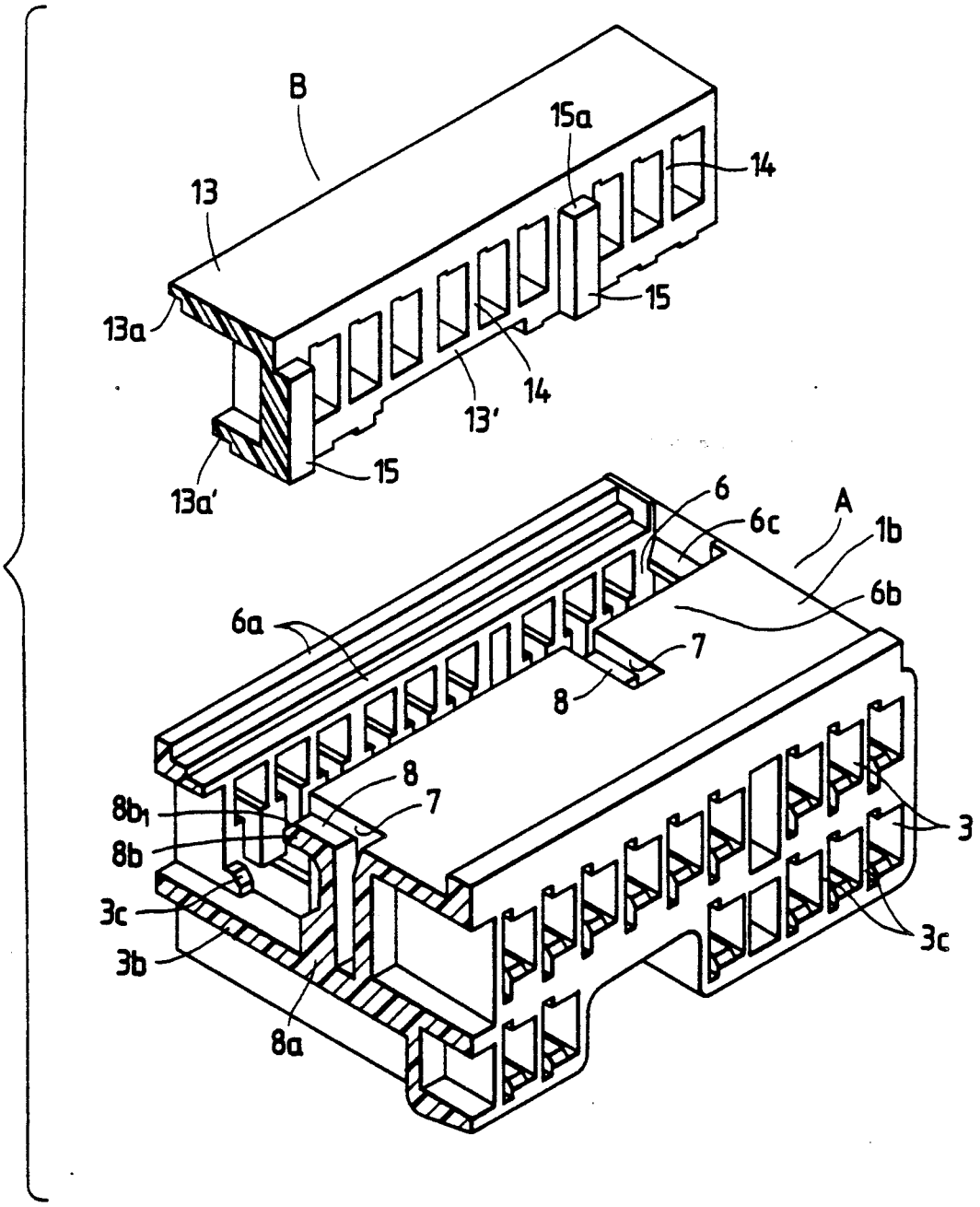
FIG. 2 is an exploded perspective view of the connector housing taken along the line II—II of FIG. 1, as viewed from the reverse side.

In FIGS. 1 and 2, a terminal retainer B, made of a synthetic resin, is adapted to be fitted in a window 6 which is open to a lower outer peripheral wall 1*b* of a male connector housing A, also made of a synthetic resin. Reference character C denotes a metal terminal which fits into a terminal receiving chamber 3. The housing A is adapted to be fitted in a mating female connector (not shown).

A locking arm 2, which engages the mating female connector, is formed on an upper outer peripheral wall 1*a* of the housing A. Upper and lower rows of juxtaposed terminal receiving chambers 3 are provided within the housing A.

A flexible retaining arm 4 is formed integrally with and projects from an upper wall 3*a* of each terminal receiving chamber 3. The flexible retaining arm 4 is engageable with a rear shoulder 9 of an electric contact portion $C_1$ of the metal terminal C so as to prevent rearward withdrawal of the metal terminal C; this is a primary retention function. A stopper wall 5 is provided at the above open portion of the terminal receiving chamber 3 to prevent forward removal of the metal terminal C.

The window 6 is provided at the front portion of the lower outer peripheral wall lb, and extends across the plurality of terminal receiving chambers 3. An intermediate window 6' corresponding to the window 6 is provided in a partition wall 3*b* separating the upper and lower terminal receiving chambers from each other, and communicates vertically with the window 6.

As seen in FIG. 2, the front edge of the window 6 has a plurality of steps 6*a*, formed into a stair shape. Two grooves 7, 7 reaching the partition wall 3*b* are formed in the rear edge of the window 6, spaced a suitable distance from each other. A locking arm 8 for the terminal retainer B is provided in each groove 7.

The locking arm 8 has a hook-shape, and includes a flexible body 8*a* extending vertically from the partition wall 3*b*, and an arm portion 8*b* extending from the body 8*a* toward the window 6. The distal end face of the arm portion 8*b* is tapered, as at $8b_1$. A provisional lock seat 6*c* for the terminal retainer B is provided at the end of the window 6.

The terminal retainer B has a frame made up of a plurality of partition plates 14 interconnected at their upper and lower ends by two lid members 13 and 13'.

The lid members 13 and 13' are sized so as substantially to close the windows 6 and 6', respectively. The pitch of the partition walls 14 is the same as the pitch of spaced-apart walls 3c provided between any two adjacent ones of the terminal receiving chambers 3 of the housing A. A provisional lock projection 14a, which engages the seat 6c, is formed on the outermost partition wall 14 of the terminal retainer B.

At the front of the terminal retainer B, one lid member 13 projects forwardly beyond the other lid member 13', and a recess 13a for mating with the step 6a of the window 6 is provided at the inner side of the projecting end of the lid member 13. Vertically-extending projections 15, corresponding respectively to the grooves 7, are provided at the rear of the terminal retainer B. One end 15a of the projection 15 is at a level lower than the lid member 13, and serves as an engagement portion for engagement with the locking arm 8.

Retaining projections 16 are formed on the inner surface of each of the lid members 13 and 13', and correspond respectively to the terminal receiving chambers 3. The retaining projection 16 has retaining walls 17 on opposite sides thereof at a rear portion thereof. The retaining projection 16 is engageable in a retaining hole 11 in a base portion 10 of the metal terminal C. The retaining walls 17 are engageable respectively with retaining pieces 12 provided rearwardly of the retaining hole 11 at the opposite sides of the metal terminal C.

Next, use of the terminal retainer B and the operation thereof will be described with reference to FIGS. 3A to 3C and FIGS. 4A to 4C.

Figure 3A:
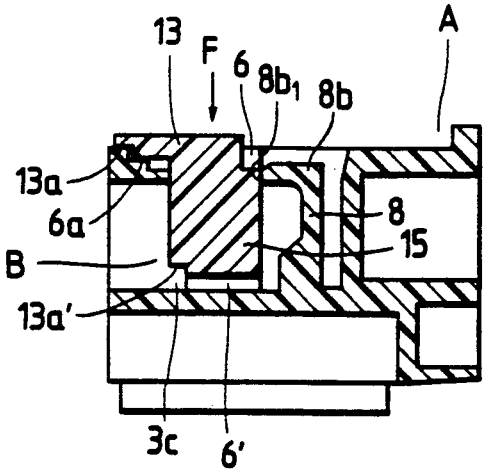
FIGS. 3A to 3C are cross-sectional views of the connector housing and the terminal retainer, showing a provisionally-locked condition, a condition of shifting from the provisionally-locked condition into a completely-locked condition, and the completely-locked condition, respectively.

FIG. 3A shows a provisionally-locked condition of the terminal retainer B. The terminal retainer B is inserted into the windows 6 and 6' from the upper side of the housing A. At this time, each projection 15 moves slidingly relative to the end face of the arm portion 8b of the corresponding locking arm 8, and the recessed portion 13a of the lid member 13 abuts the uppermost step 6a of the window 6. At the same time, a recessed portion 13a' of the lid member 13 abuts the stoppers 3c on the partition wall 3b, whereupon the terminal retainer B is stopped. Also, the projection 14a of the partition plate 14 slides over the seat 6c. As a result, the terminal retainer B is prevented from upward and downward movement, thus providing provisional locking.

In this condition, even if a vertical external force F acts on the terminal retainer B, there is no possibility that the terminal retainer B is further forced into the housing, since the step 6a, etc., function as stoppers.

Figure 3B:
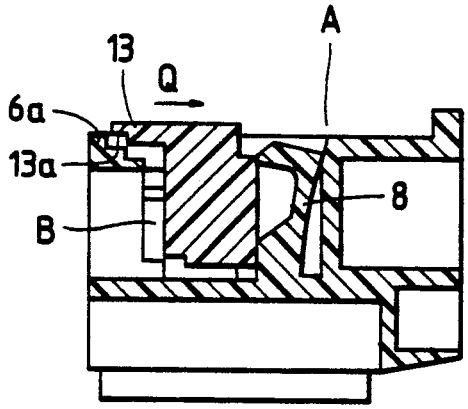

FIG. 3B shows a step of shifting the terminal retainer B into a completely-locked condition. The lid member 13 is urged in a direction of arrow Q to flex each locking arm 8 rearwardly.

Figure 3C:
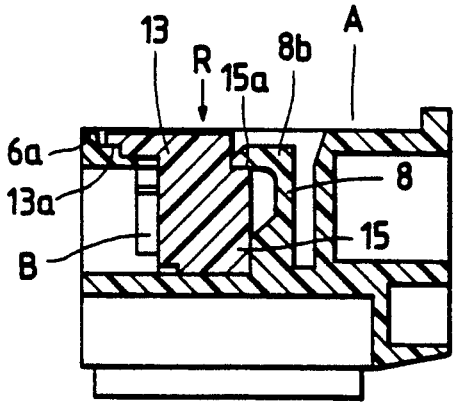

FIG. 3C shows the completely locked condition. When the lid member 13 is urged downwardly in a direction of arrow R, the terminal retainer B is moved into the housing. Because of the resilient restoring action of the locking arm 8, the locking arm portion 8b holds the end face 15a of the projection 15 from above. At this time, the recessed portion 13a of the lid member 13 is mated with the next step 6a of the window 6.

The actual shifting of the terminal retainer B from the provisionally-locked condition (FIG. 3A) into the completely-locked condition is effected smoothly in one step, that is, by pushing down the lid member 13 obliquely with one's thumb or the like.

When the locked condition of the terminal retainer B which, for example, has resulted from an erroneous insertion of the metal terminal C, is to be released, a tool such as a screwdriver is inserted between the retainer B and the locking arm 8 in the condition shown in FIG. 3C. The arm 8 is flexed as shown in FIG. 3B, and then the terminal retainer B is removed.

Figure 4A:
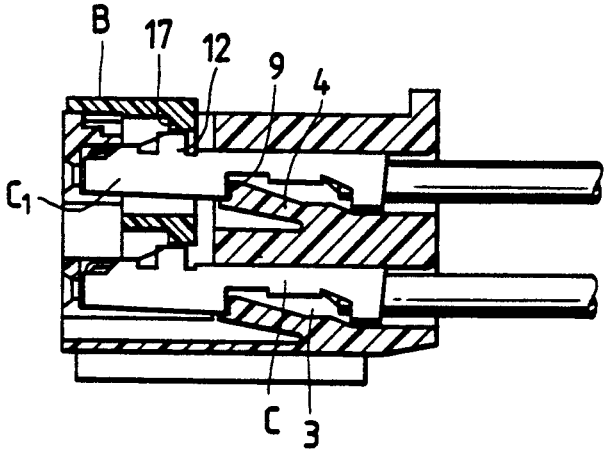
FIGS. 4A to 4C are cross-sectional views corresponding respectively to FIGS. 3A to 3C, showing the relation between the terminal retainer and a metal terminal.
Figure 4B:
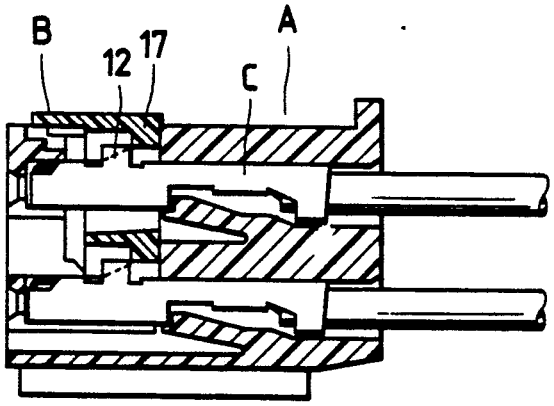
Figure 4C:
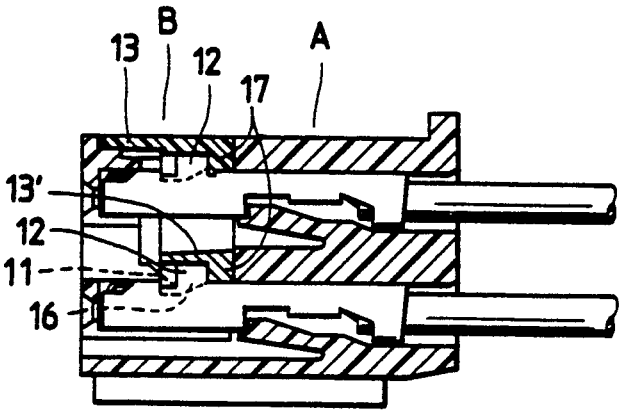

FIGS. 4A to 4C respectively show the conditions corresponding to the conditions of FIGS. 3A to 3C. Fig. 4A shows the condition in which, in the provisionally-locked condition of the terminal retainer B, the metal terminal C inserted into the terminal receiving chamber 3 from the rear thereof is held in a primary retaining condition by engagement between the flexible retaining arm 4 and the rear shoulder 9 of the electric contact portion $C_1$. The retaining pieces 12 of the metal terminal C are substantially opposed to the retaining walls 17 of the terminal retainer B, respectively.

FIG. 4B shows the condition in which the retaining walls 17 are displaced rearwardly of the retaining pieces 12 as a result of a rearward movement of the terminal retainer B.

FIG. 4C shows the completely-locked condition in which the retaining projection 16 of the lid member 13, 13' is fitted in the retaining hole 11 of the metal terminal C, and the retaining walls 17 on the opposite sides of the retaining projection 16 are disposed rearwardly of the rear ends of the respective retaining pieces 12.

Therefore, rearward withdrawal of the metal terminal C is prevented by the double retaining action achieved by the flexible retaining arm 4, and the engagement between the retaining projection 16 and the retaining walls 17.

Figure 5:
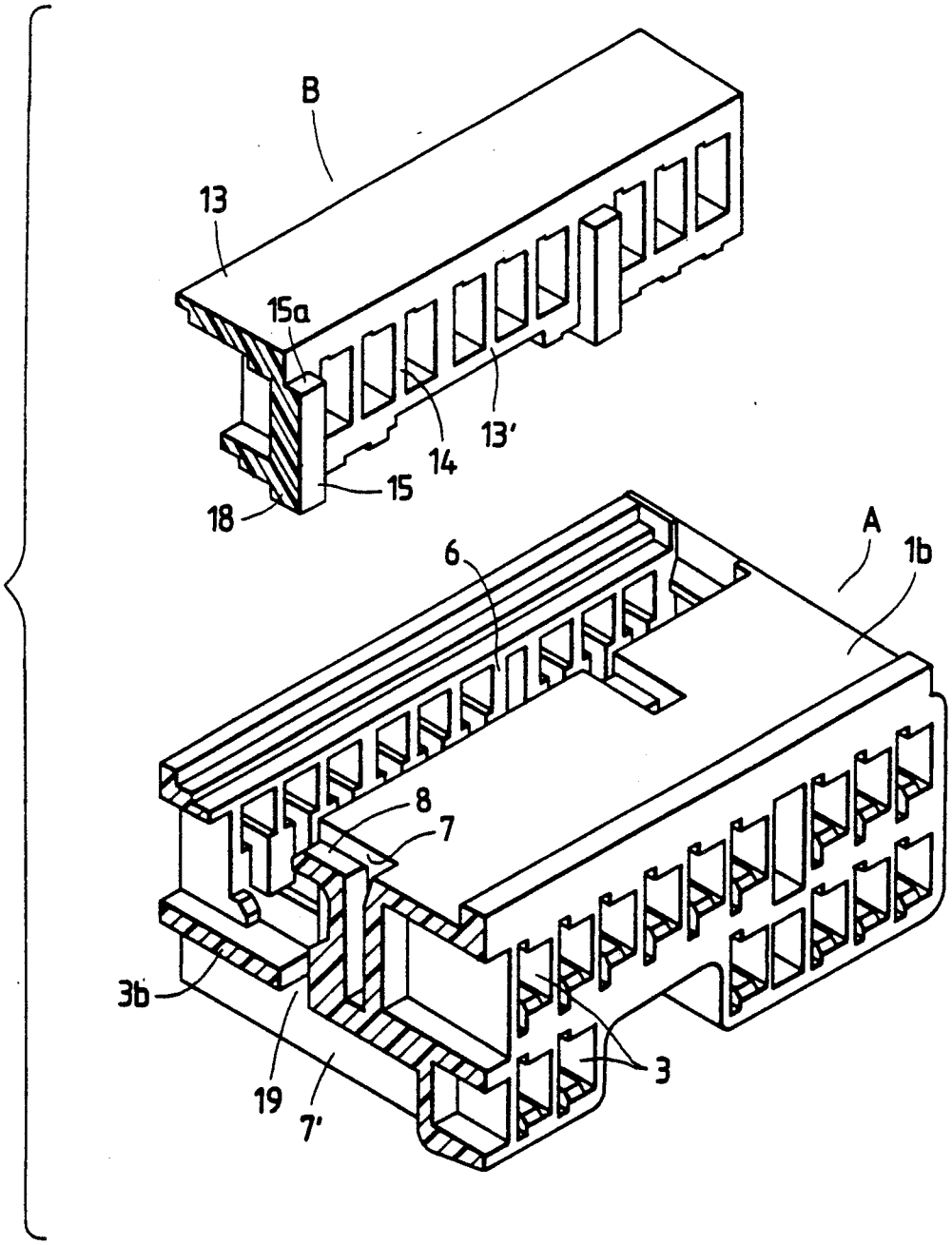
FIG. 5 is an exploded perspective view of important portions of a connector housing and a terminal retainer according to another embodiment of the invention.

In another embodiment shown in FIG. 5, a lock releasing projection 18 is provided on the end 15a of each projection 15 remote from the end face 15a engageable with the locking arm 8, and guide holes 19 for guiding the projections 18 are formed in the partition wall 3b.

Figure 6:
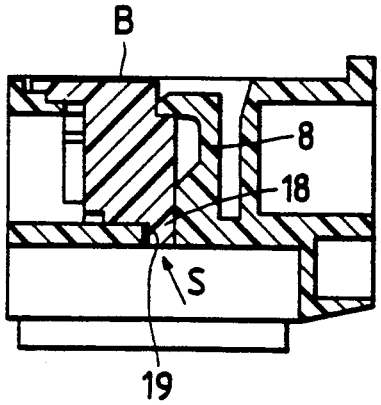
FIG. 6 is a cross-sectional view, showing the relation between the connector housing and the terminal retainer of FIG. 5.
Figure 8:
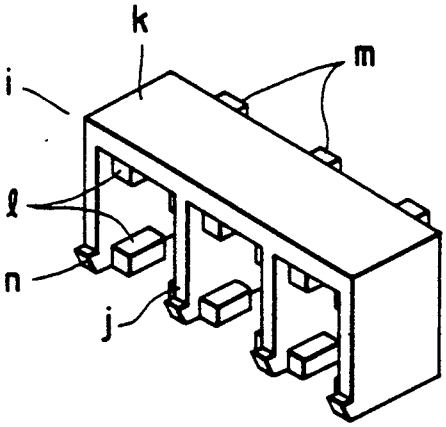
FIGS. 8 and 9 are respective perspective views of the terminal retainer and a metal terminal of FIGS. 7A and 7B.
Figure 9:
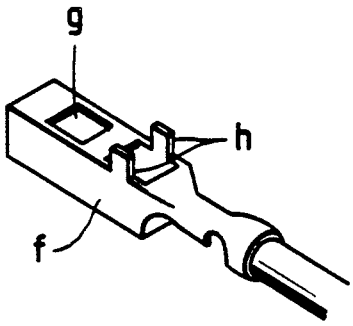
Figure 7A:
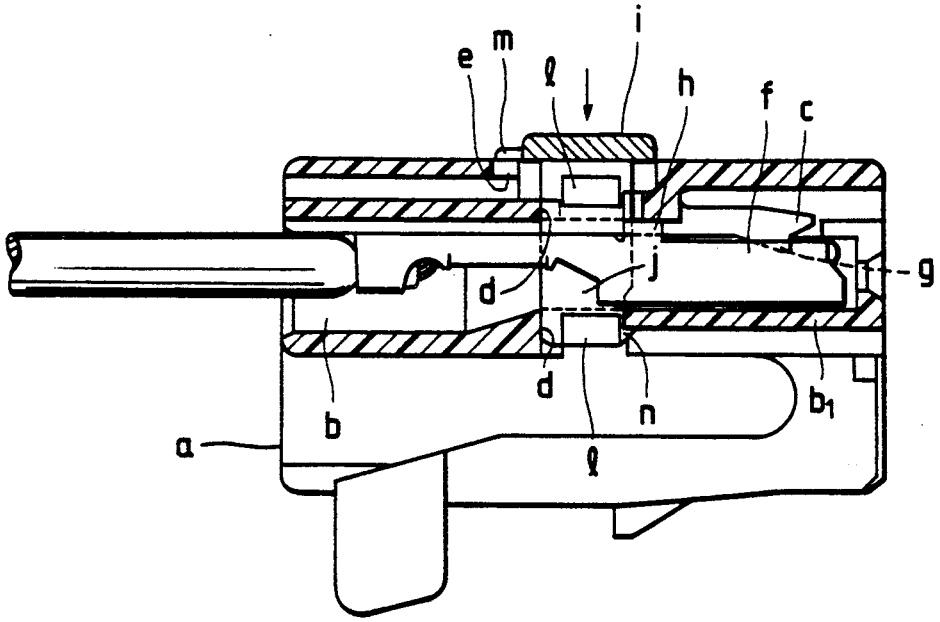
FIGS. 7A and 7B are cross-sectional views of a conventional connector housing and a terminal retainer, showing a provisionally-locked condition and a completely-locked condition, respectively.
Figure 7B:
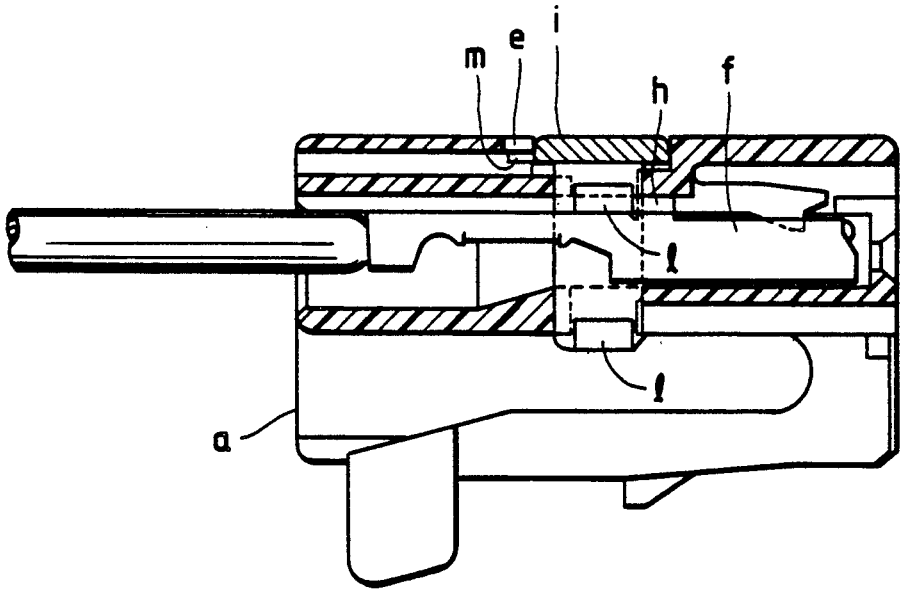

In this case, the locking arm 8 is flexed rearwardly as described above, and in this condition a tool (not shown) is inserted from a groove 7' provided at the opposite side of the groove 7, as shown in FIG. 6, to urge the lock releasing projection 18 obliquely in a direction of arrow S, thereby releasing the completely-locked condition. With this arrangement, the terminal retainer B can be removed without damaging the locking arm 8.

Further, in the completely-locked condition of the terminal retainer B, the locking arms 18 are disposed in registry with and positioned relative to the guide holes 19, respectively, and therefore the terminal retainer B is prevented from rattling.

In the embodiments just described, although the housing has upper and lower rows of terminal receiving chambers 3, the invention similarly is applicable to an arrangement in which the housing has three rows (that is, upper, intermediate and lower rows) of terminal receiving chambers. Further, where the housing has one row of terminal receiving chambers, the lid member 13' is merely in the form of a lid plate without retaining projections 16, and a recess for engagement with such a lid member is formed in the inner surface of the upper outer peripheral wall 1a. The terminal retainer B may be applied to the mating female connector housing, cooperating with the male connector housing A, in a similar manner.

As described above, according to the invention, the terminal retainer attached to the connector housing can be shifted from the provisionally-locked condition to the completely-locked condition by a two-step operation in which the forces are applied to the terminal retainer in a direction perpendicular to the direction of the insertion. Therefore, during transport or assembly, the terminal retainer will not be brought inadvertently into the completely-locked condition, and the insertion of the metal terminal can be effected smoothly.

Further, the terminal retainer has retaining projections which are engageable respectively in the retaining hole in the base of the metal terminal, and also has the retaining walls engageable respectively with the retaining pieces of the metal terminal. Thus, an increased number of such retaining portions are provided, thereby increasing the retaining force.

While the invention has been described in detail above with reference to a preferred embodiment, various modifications within the scope and spirit of the invention will be apparent to people of working skill in this technological field. Thus, the invention should be considered as limited only by the scope of the appended claims.

What is claimed is:

1. An electric connector comprising:

a connector housing having opposed outer peripheral walls and a plurality of juxtaposed terminal receiving chambers;

a plurality of metal terminals which are inserted respectively into the terminal receiving chambers, each of said metal terminals having a retaining hole formed in a base thereof;

a terminal retainer, combined with and movable in at least two different directions within said connector housing, for shifting from a provisionally-locked condition to a completely-locked condition;

a window, provided in one of said opposed outer peripheral walls of the connector housing, the window extending across the plurality of terminal receiving chambers, and extending through the connector housing to the other of said opposed outer peripheral walls;

a hook-shaped deformable locking arm, provided at one side edge of said window in facing relation to said portion of said window extending through said connector housing;

said terminal retainer including a lid member for closing the window, the lid member having at its inner surface retaining projections each engageable in the retaining hole of a respective one of the metal terminals, and having a projection engageable with the locking arm;

partition plates connected to said lid member and corresponding in number to said plurality of terminal receiving chambers;

wherein the terminal retainer is provisionally locked to the connector housing upon insertion into the connector housing at the window in a first direction, such that, in the provisionally-locked condition, when the terminal retainer is moved in a second direction toward the locking arm, the second direction being different from the first direction, the locking arm is engaged with an end face of the projection, thereby completely locking the terminal retainer to the connector housing, and at the same time the retaining projections are engaged in the retaining holes, so as to prevent rearward withdrawal of the metal terminals.

2. An electric connector according to claim 1, further comprising a retaining piece formed on at least one of opposite sides of said base of each of said metal terminals, and a retaining wall, provided at a side face of the retaining projection of the lid member, for engaging said retaining piece.

3. An electric connector comprising:

a connector housing having therein a plurality of vertically and horizontally-juxtaposed terminal receiving chambers in upper and lower rows, and including at least one outer peripheral wall and a partition wall, said partition wall separating the upper and lower rows of terminal receiving chambers from each other;

a plurality of metal terminals which are inserted respectively into the terminal receiving chambers, each of said metal terminals having a retaining hole formed in a base thereof;

a terminal retainer, combined with and movable in at least two different directions within the connector housing, for shifting from a provisionally-locked condition to a completely-locked condition;

an outer window, provided in one outer peripheral wall of the connector housing, said window extending across the plurality of terminal receiving chambers, and an inner window extending vertically through the connector housing;

a hook-shaped deformable locking arm, provided at one side edge of the outer window in facing relation to said portion of said outer window extending across the plurality of terminal receiving chambers;

wherein the terminal retainer is in the form of a frame having a plurality of lid members for closing the outer window and the inner window, and further includes partition plates connected between the lid members and corresponding to the plurality of terminal receiving chambers; wherein each lid member has, at an inner surface thereof, retaining projections, each engageable in the retaining hole of a respective one of said metal terminals, the frame having a projection engageable with the locking arm;

wherein the terminal retainer is provisionally locked to the connector housing upon insertion into the connector housing at the outer window in a first direction, such that, when provisionally locked, and when the terminal retainer is moved in a second direction toward the locking arm, the second direction being different from the first direction, the locking arm is engaged with an end face of the projection, thereby completely locking the terminal retainer to the connector housing, while at the same time the retaining projections are engaged in the retaining holes, thereby preventing rearward withdrawal of the metal terminals.

4. An electric connector according to claim 3, further comprising a retaining piece formed on at least one of opposite sides of the base of each metal terminal, and a retaining wall, provided at a side face of each retaining projection of each lid member, for engaging the retaining piece.

5. An electric connector according to claim 3, further comprising a lock releasing projection provided on the other end of the projection of the terminal retainer remote from its end face engageable with the locking arm, the partition wall having a guide hole for guiding the lock releasing projection.

6. An electric connector according to claim 4, further comprising a lock releasing projection provided on the other end of the projection of the terminal retainer remote from its end face engageable with the locking arm, the partition wall having a guide hole for guiding the lock releasing projection.

* * * * *